US007225887B2

(12) United States Patent
Kriesels

(10) Patent No.: US 7,225,887 B2
(45) Date of Patent: Jun. 5, 2007

(54) METHOD OF DRILLING AN ULTRA-SHORT RADIUS BOREHOLE

(75) Inventor: Petrus Cornelis Kriesels, Assen (NL)

(73) Assignee: Shell Oil Company, Houston, TX (US)

( * ) Notice: Subject to any disclaimer, the term of this patent is extended or adjusted under 35 U.S.C. 154(b) by 126 days.

(21) Appl. No.: 10/475,583

(22) PCT Filed: Apr. 23, 2002

(86) PCT No.: PCT/EP02/04516

§ 371 (c)(1),
(2), (4) Date: Dec. 11, 2003

(87) PCT Pub. No.: WO02/086278

PCT Pub. Date: Oct. 31, 2002

(65) Prior Publication Data

US 2004/0129414 A1 Jul. 8, 2004

(30) Foreign Application Priority Data

Apr. 23, 2001 (EP) ..... 01303703

(51) Int. Cl.
*E21B 7/08* (2006.01)

(52) U.S. Cl. ..... 175/61; 166/117.5; 166/313; 175/75; 175/325.1

(58) Field of Classification Search ..... 175/61, 175/75, 325.1; 166/50, 313, 117.5
See application file for complete search history.

(56) References Cited

U.S. PATENT DOCUMENTS 1,595,922 A 8/1926 Prindle
1,804,819 A * 5/1931 Spencer, Jr. et al. ..... 175/81
2,699,920 A * 1/1955 Zublin ..... 175/81
2,852,230 A * 9/1958 Garrison ..... 175/58
3,285,350 A 11/1966 Henderson ..... 175/57
3,398,804 A * 8/1968 Holbert ..... 175/61
4,007,797 A * 2/1977 Jeter ..... 175/26
4,402,551 A * 9/1983 Wood et al. ..... 299/5
4,880,067 A 11/1989 Jelsma ..... 175/107
5,012,877 A * 5/1991 Winters et al. ..... 175/80

(Continued)

FOREIGN PATENT DOCUMENTS

DE 3832715 A1 3/1990

(Continued)

OTHER PUBLICATIONS

"New Tools", Techniques Reduce High-Angle Drilling Costs, Offshore, Petroleum Publishing Co., Tulsa, US, vol. 49, No. 11, Nov. 1, 1989, pp. 47-49, 52-54, p. 53, paragraph "short radius drilling".

(Continued)

*Primary Examiner*—Jennifer H. Gay

(57) ABSTRACT

A method of drilling a borehole into an earth formation using a drill string having an upper part and a lower part which is more flexible than the upper part, the method involving drilling a first section of the borehole, drilling a second section of the borehole from the first borehole section, the second section extending at a selected inclination angle relative to the first section. During drilling of the second section the drill string is lowered through the borehole in a manner that the upper drill string part remains in the first section and the lower drill string part extends into the second borehole section.

36 Claims, 7 Drawing Sheets

U.S. PATENT DOCUMENTS 5,435,400 A * 7/1995 Smith ..... 175/61
5,458,209 A 10/1995 Hayes et al. ..... 175/61
5,469,925 A * 11/1995 Mueller et al. ..... 175/61
5,490,569 A 2/1996 Brotherton et al. ..... 175/61
5,699,866 A 12/1997 Cousins et al.
5,704,437 A * 1/1998 Murray ..... 175/61
5,862,862 A * 1/1999 Terrell ..... 166/298
6,047,774 A * 4/2000 Allen ..... 166/313
6,135,215 A * 10/2000 Ericksen ..... 175/61
6,202,761 B1 * 3/2001 Forney ..... 175/61
6,220,372 B1 * 4/2001 Cherry ..... 175/81
6,260,623 B1 * 7/2001 Schick ..... 166/313
6,419,020 B1 * 7/2002 Spingath ..... 166/313
6,920,945 B1 * 7/2005 Belew et al. ..... 175/67
2005/0250657 A1 11/2005 Wu et al. ..... 508/591

FOREIGN PATENT DOCUMENTS

| | | |
|---|---|---|
| EP | 257744 A2 | 3/1988 |
| FR | 2232669 | 1/1975 |
| RU | 2103472 | 1/1998 |
| WO | 99/29997 | 6/1999 |

OTHER PUBLICATIONS

International Search Report dated Aug. 22, 2002.

David Hill et al., "Reentry Drilling Gives New Life to Aging Fields", Oilfield Reveiw, pp. 4-17.

* cited by examiner

METHOD OF DRILLING AN ULTRA-SHORT RADIUS BOREHOLE

The present application claims priority on European Patent Application 01303703.1 filed on 23 Apr. 2001.

FIELD OF THE INVENTION

The present invention relates to a method of drilling a borehole into an earth formation. More particularly, a method for drilling an ultra short radius borehole.

BACKGROUND OF THE INVENTION

In the industry of wellbore drilling it is common practice to drill one or more branch boreholes from a main borehole in order to reach different zones of hydrocarbon containing formations from a single surface location. Such branch boreholes deviate from the main borehole at rather low curvatures due to operational restrictions imposed on the drill strings used. In case the branch borehole is to be drilled into a relatively thin hydrocarbon fluid containing layer, it is difficult or impossible to start drilling of the branch borehole from the main borehole at a location positioned in the layer and to proceed drilling into the layer.

SUMMARY OF THE INVENTION

It is an object of the invention to provide an improved method of drilling a borehole, which overcomes the aforementioned drawback of conventional drilling methods.

In accordance with the invention there is provided a method of drilling a borehole into an earth formation using a drill string having an upper part and a lower part which is more flexible than the upper part, the method comprising drilling a first section of the borehole, drilling a second section of the borehole from said first borehole section, said second section extending at a selected inclination angle relative the first section, wherein during drilling of the second section the drill string is lowered through the borehole in a manner that the upper drill string part remains in the first section and the lower drill string part extends into the second borehole section.

It is thereby achieved that the second borehole section can be drilled at a relatively high curvature since the lower drill string part is relatively flexible. The less flexible upper drill string part remains in the first borehole section and does therefore not have to be bent to the degree of bending required for the lower drill string section.

In an attractive embodiment of the method of the invention the upper drill string part is provided with a downhole motor, which rotates the lower drill string part during drilling of the second borehole section.

Suitably the first borehole section is substantially straight and the second borehole section is a curved section. For example, the first borehole section can form a main borehole and the second borehole section can form a branch borehole of the main borehole.

BRIEF DESCRIPTION OF THE DRAWINGS

The invention will be described hereinafter in more detail and by way of example with reference to the accompanying drawings in which.

DETAILED DESCRIPTION OF THE PREFERRED EMBODIMENT

Figure 1:
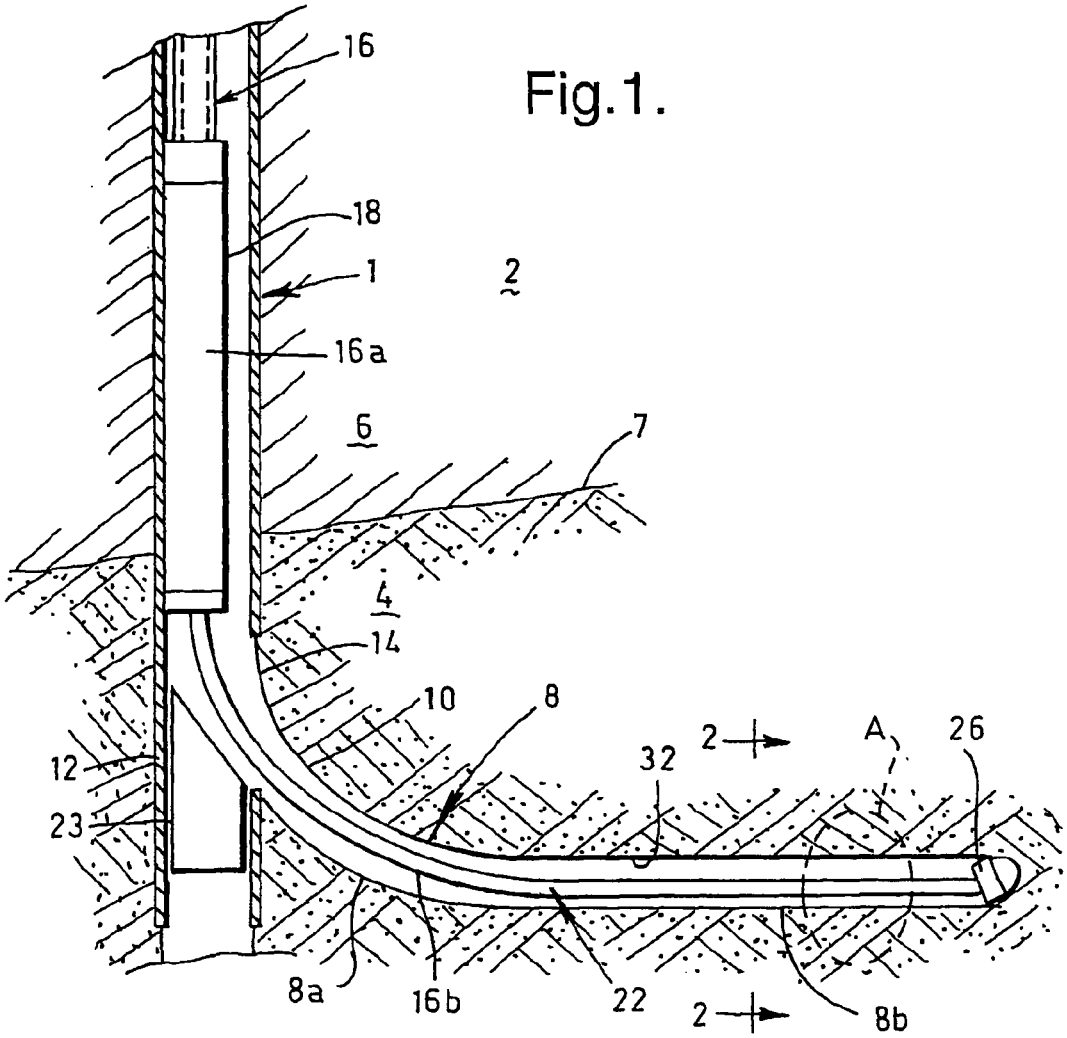
FIG. 1 schematically shows an embodiment of a drilling system for use in the method of the invention.

In the Figures like reference numerals relate to like components.

Referring to FIG. 1 there is shown a main borehole 1 extending from surface (not shown) into an earth formation 2 which includes an oil bearing layer 4 and a cap rock layer 6 located above the oil bearing layer 4. The interface between the oil bearing layer 4 and the cap rock layer 6 is indicated by reference sign 7. A branch borehole 8 extends from a branch point 10 of the main borehole 1 laterally into the oil bearing layer 4, with branch point 10 located below the cap rock layer 6. The branch borehole 8 has an initial curved section 8*a* and a subsequent straight section 8*b*. The main borehole 1 is provided with a wellbore casing 12, which has an opening 14 providing access to the branch borehole 8.

A system for use in the method of the invention includes a tubular drill string 16 extending from a drilling rig (not shown) at surface into the main borehole 1, the drill string 16 being formed of an upper drill string part 16*a* and a lower drill string part 16*b*, which is more flexible than the upper part 16*a*. The upper drill string part includes a hydraulic downhole motor 18 located in the main borehole 1. The lower drill string part 16*b* includes a flexible shaft assembly 22 extending from the motor 18 into the branch borehole 8. The curvature of the shaft assembly 22 is relatively high compared to allowable curvatures of conventional drill strings, due to the flexibility of the shaft assembly 22. A whipstock 23 is fixedly arranged in the casing 12 below the branch point 10 so as to guide the flexible shaft assembly 22 into the branch borehole 8.

Figure 2:
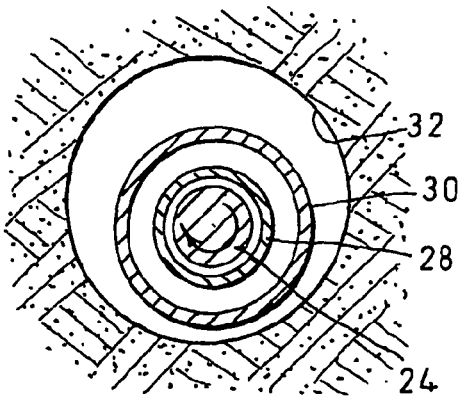
FIG. 2 schematically shows cross-section 2—2 of FIG. 1.
Figure 3:
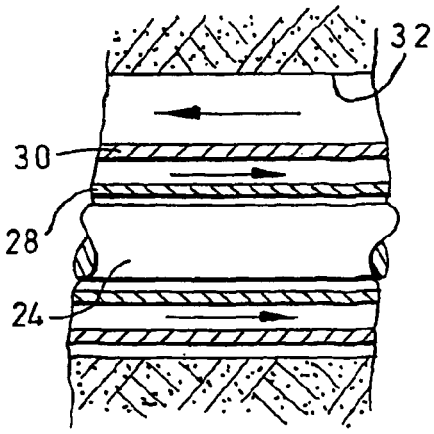
FIG. 3 schematically shows a longitudinal section of detail A of FIG. 1.

Referring further to FIGS. 2 and 3, the shaft assembly 22 includes a flexible drive shaft 24 connected to the output shaft (not shown) of the downhole motor and arranged to drive a drill bit 26. A flexible tubular orienting shaft 28 extends around the drive shaft 24, and a flexible hose 30 extends around the orienting shaft 28. In the Figures, reference sign 32 indicates the wall of the branch borehole 8. The orienting shaft 28 is at one end thereof fixedly connected to the motor housing (not shown) and at the other end thereof to the drill bit 26 by means of a bearing section (not shown) allowing rotation of the drill bit 26 relative to the orienting shaft 28. The bearing section is arranged such that the axis of rotation of drill bit 26 is tilted relative to the longitudinal axis of orienting shaft 28. The flexible drive shaft and/or the flexible orienting shaft can, for example, be made of Titanium, which has a low modulus of elasticity, or from an assembly of flexible layers.

Figure 4:
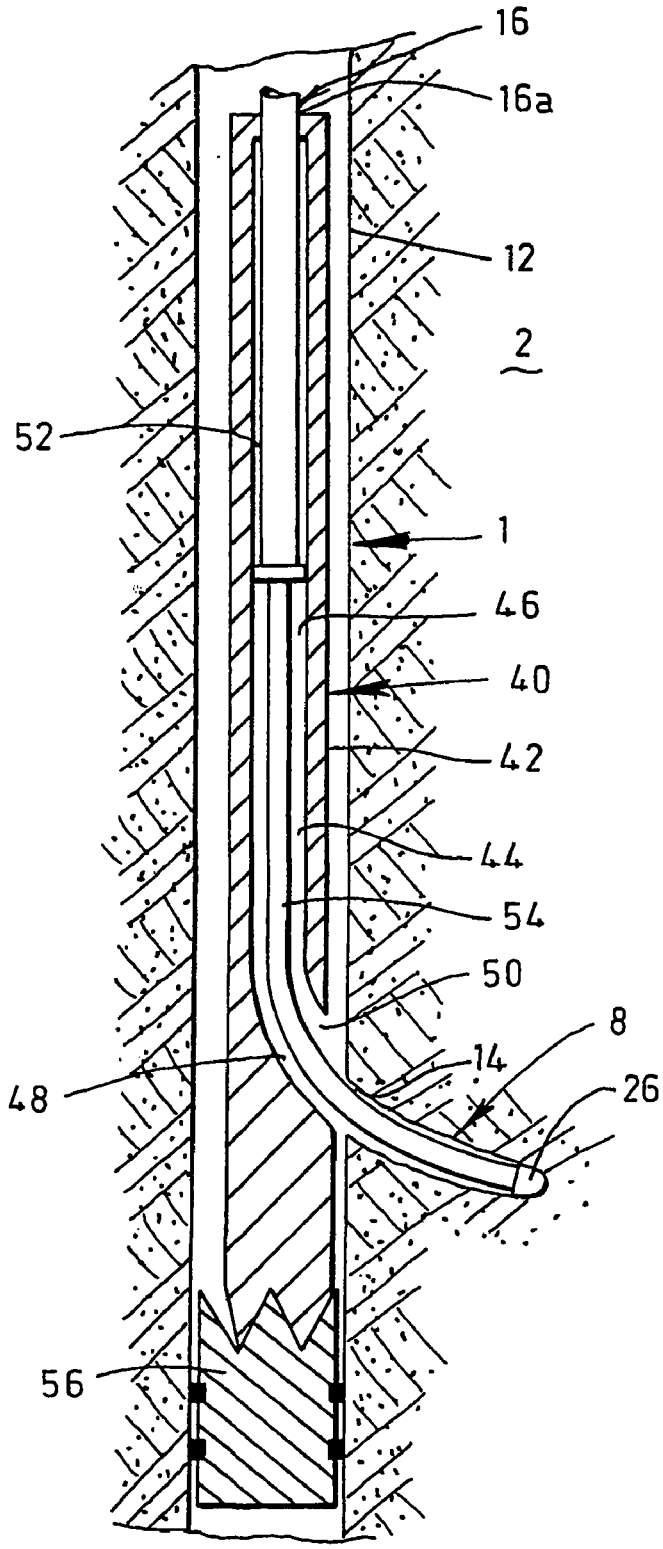
FIG. 4 schematically shows an alternative embodiment of a drilling system for use in the method of the invention.

In FIG. 4 is shown an alternative system 40 for use in the method of the invention, whereby the tubular drill string 16 is applied. A tubular housing 42 is arranged in the main borehole 1, the housing having a guide channel 44 including an upper, longitudinal, section 46 and a lower, curved, section 48 directed to the branch borehole 8. The curved section 48 has an outlet opening 50 arranged opposite the window opening 14. The upper drill string section 16*a* includes hydraulic downhole motor 52, which is slide ably arranged in the guide channel 44. A flexible shaft assembly 54 similar to the flexible shaft assembly 22 described with respect to FIGS. 1, 2, 3 is connected to the motor 52 and extends through the guide channel 44 via opening 50 into the branch borehole 8. The shaft assembly 54 interconnects the motor 52 and the drill bit 26 in the same manner and with the same functionality as described hereinbefore with respect to shaft assembly 22.

The housing 42 is at the lower end thereof provided with a support profile matching a corresponding support profile of a support member 56 anchored in the casing 12 by any suitable means. The support profiles of the housing 42 and the support member 56 are such that the housing can be positioned on the support member at different azimuth angles in the main borehole 1. The housing 42 can be run in the borehole with the drill string 16, at which stage the housing is hung up on a shoulder near the lower end of the motor.

Figure 5:
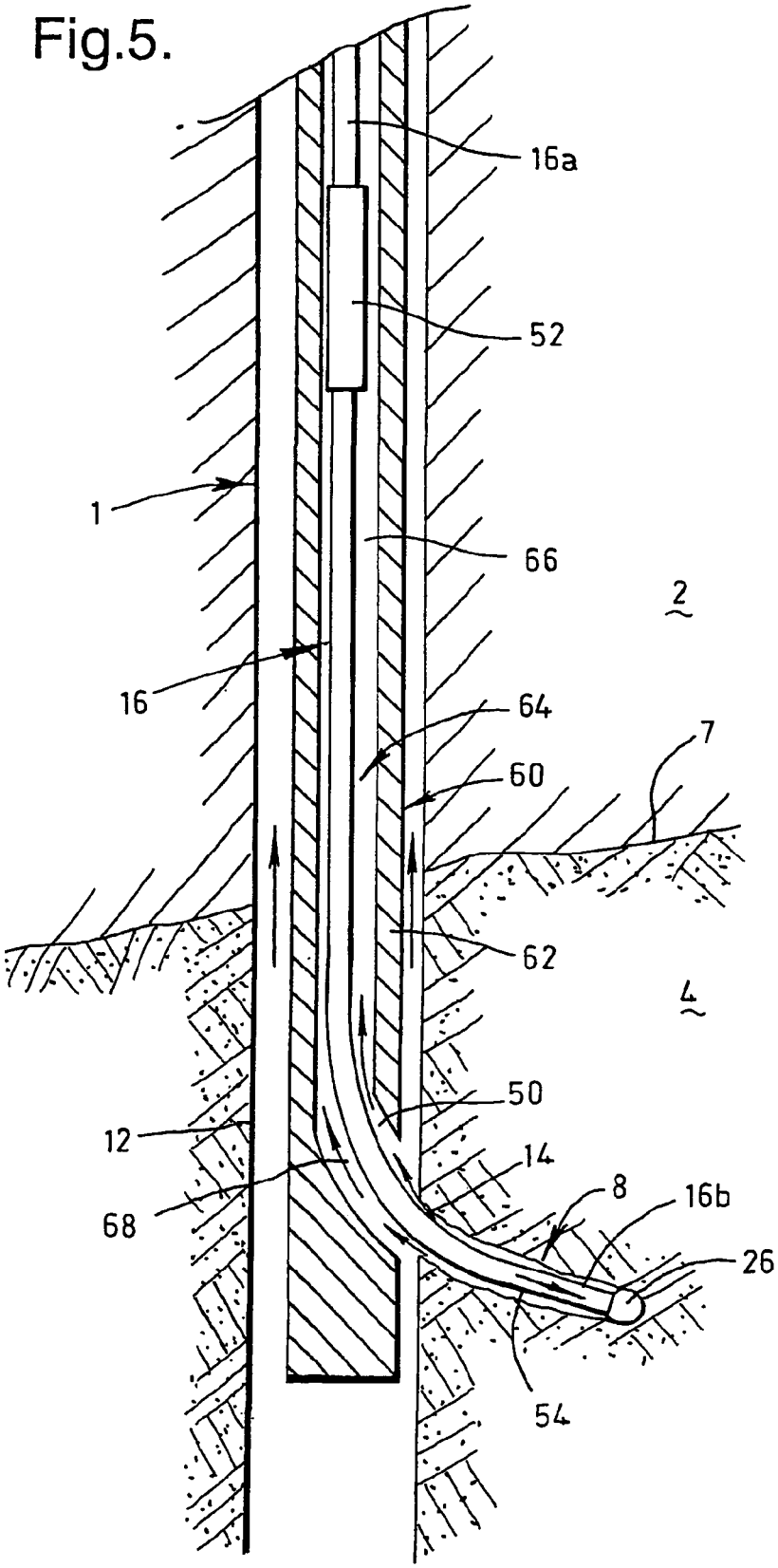
FIG. 5 schematically shows another alternative embodiment of a drilling system for use in the method of the invention.

In FIG. 5 is shown a further alternative system 60 for use in the method of the invention, whereby the tubular drill string 16 is applied. The system 60 is to some extent similar to the system 40 of FIG. 4, except that the drill string 16 is guided through a tubular element 62 supported from surface instead of being guided by the housing 42. The tubular element 62 is arranged in the main borehole 1 and has a guide channel 64 including an upper, longitudinal, section 66 and a lower, curved, section 68 directed to the branch borehole 8. The curved section 68 has outlet opening 50 arranged opposite the window opening 14. Similarly to the embodiment of FIG. 4, the upper drill string section 16*a* includes hydraulic downhole motor 52 slide ably arranged in the guide channel 64, and flexible shaft assembly 54 which is connected to the motor 52 and extends via guide channel 64 and opening 50 into the branch borehole 8.

The tubular element 62 can, for example, be a drilling tubular for conventional wellbore drilling, or a production tubing for conventional hydrocarbon fluid production from the earth formation.

Figure 6:
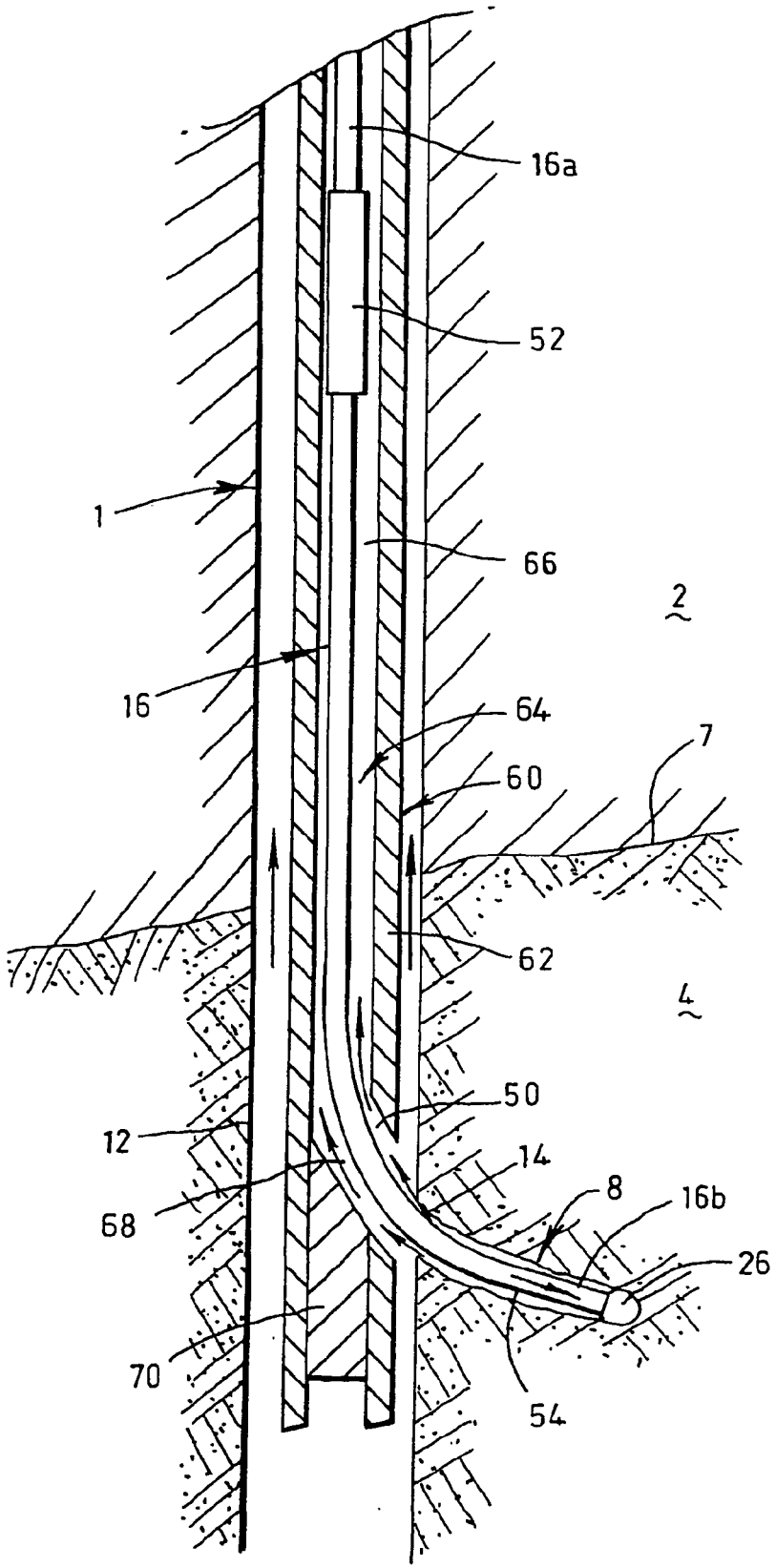
FIG. 6 schematically shows a modification to the embodiment of FIG. 5.

In FIG. 6 is shown a modification to the embodiment of FIG. 5, whereby the lower, curved, section 68 of guide channel 64 is formed by a whipstock 70 fixedly installed in the guide channel 64.

During normal operation of the system shown in FIG. 1, the main borehole 1 is drilled, the casing 12 is installed and the whipstock 23 is positioned at the desired location. After milling of the window opening 14 in the casing, the drill string 16 is lowered into the main borehole 1 until the drilling device 18 is at the position indicated in FIG. 1. Next the drill bit 26 is oriented for drilling of the initial curved section 8*a*, by rotating the orienting shaft 28 over a selected angle until the tool face of the drill bit 26 is at the desired orientation. Drilling of the branch borehole 8 starts by pumping drilling fluid through the drill string 16 so as to operate the downhole motor 18 and thereby to drive the drill bit 26 via drive shaft 24, while the orienting shaft 28 is kept stationary. Simultaneously, the drill string 16 is gradually lowered from surface so as to move the motor 18 in downward direction through the main borehole 1. As a result the flexible shaft assembly 22 is guided by whipstock 23 via window opening 14 until the drill bit 26 contacts the rock formation. Continued lowering of the downhole motor causes the drill bit 26 to cut into the rock formation and thereby to drill the initial curved section 8*a* of the branch borehole 8. When the curved branch borehole section 8*a* assumes a substantially horizontal direction, the orienting shaft 28 is rotated continuously during further drilling by rotating the entire drill string 16 from surface. It is thus achieved that the tool face orientation of the drill bit 26 varies continuously, which results in drilling of the straight section 8*b* of branch borehole 8.

After finalising drilling of the branch borehole 8 the drill string 16 and the whipstock 23 are retrieved to surface, where after suitable production equipment is installed in the main borehole 1 and/or the branch borehole 8 for production of oil from the branch borehole 8.

Figure 4A:
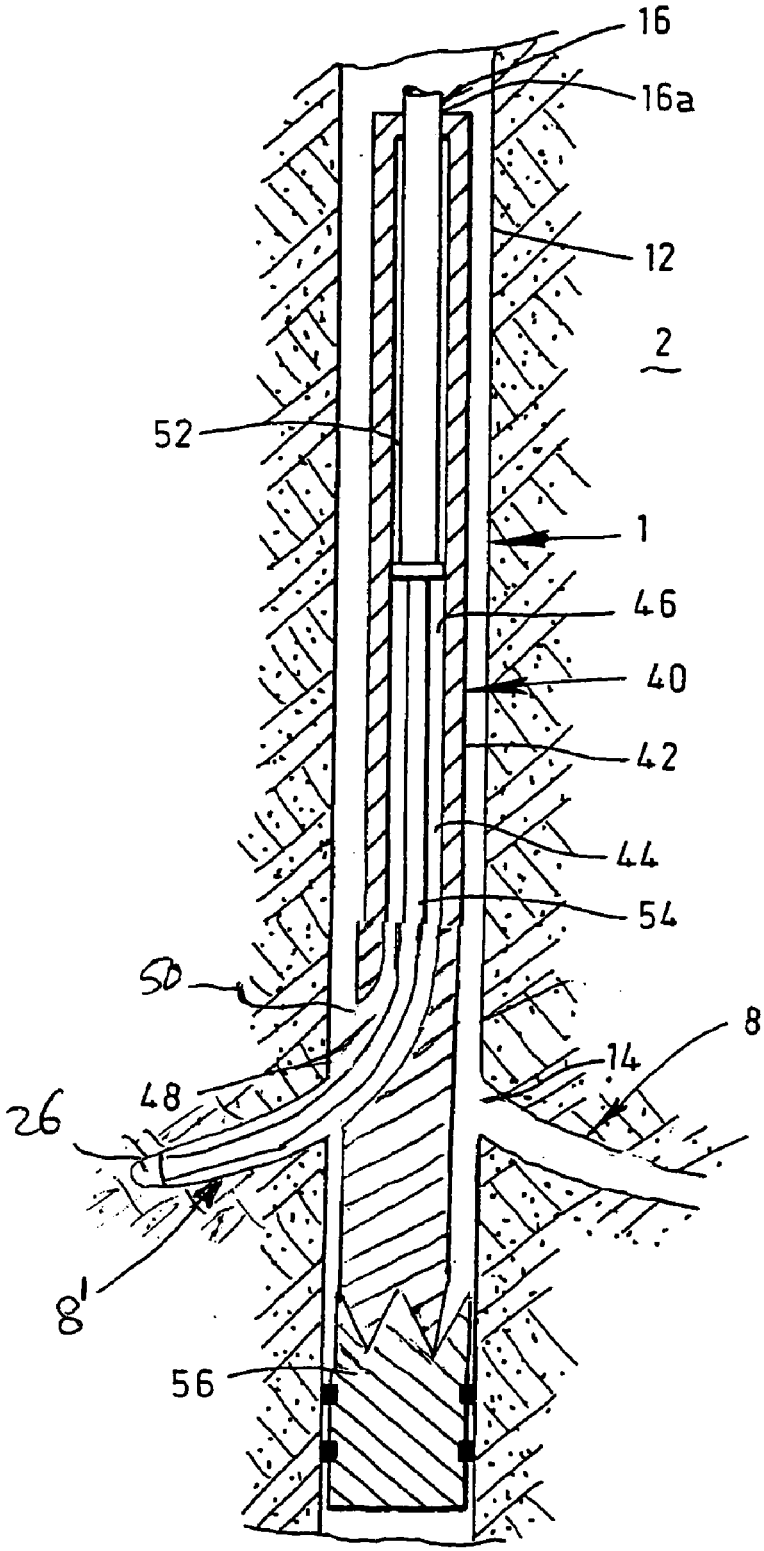
FIG. 4A schematically shows the embodiment of FIG. 4 in a reoriented position.

Normal operation of the embodiment shown in FIG. 4 is largely similar to normal operation of the embodiment of FIG. 1, except that the downhole motor 52 is guided through upper section 46 of guide channel 44, and the flexible shaft assembly 54 is guided by the curved section 48 of guide channel 44 in the direction of the branch borehole 8. Furthermore, prior to start of drilling of branch borehole 8 the tubular housing 42 is oriented on the support member 56 in accordance with the desired azimuthal direction. If desired, the housing 42 can be re-oriented after branch borehole 8 has been drilled in order to drill a further branch borehole 8' in another azimuthal direction, as shown in FIG. 4A.

Figure 5A:
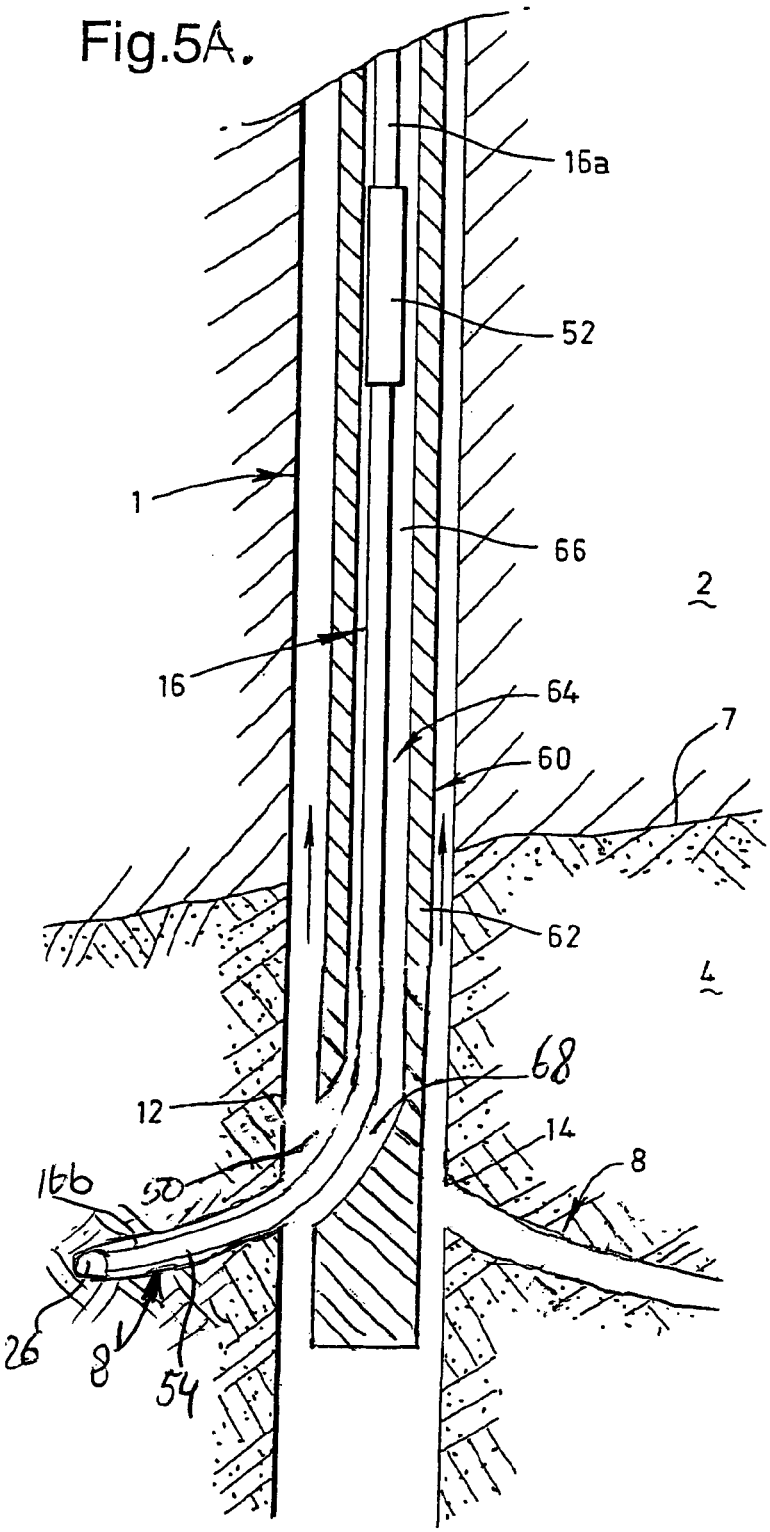
FIG. 5A schematically shows the embodiment of FIG. 5 in a reoriented position.

Normal operation of the embodiment of FIG. 5 is largely similar to normal operation of the embodiment of FIG. 4, except that the downhole motor 52 is now guided in vertical direction by guide channel 64 and the flexible shaft assembly 54 is guided by the curved section 68 of guide channel 64 in the direction of the branch borehole 8. The desired azimuthal orientation of outlet opening 50 is achieved by rotating the tubular element 62 from surface. Similarly to the embodiment of FIG. 4, the tubular element 62 can be re-oriented after drilling of branch borehole 8 in order to drill a further branch borehole 8' in another azimuthal direction, as shown in FIG. 5A.

Figure 6A:
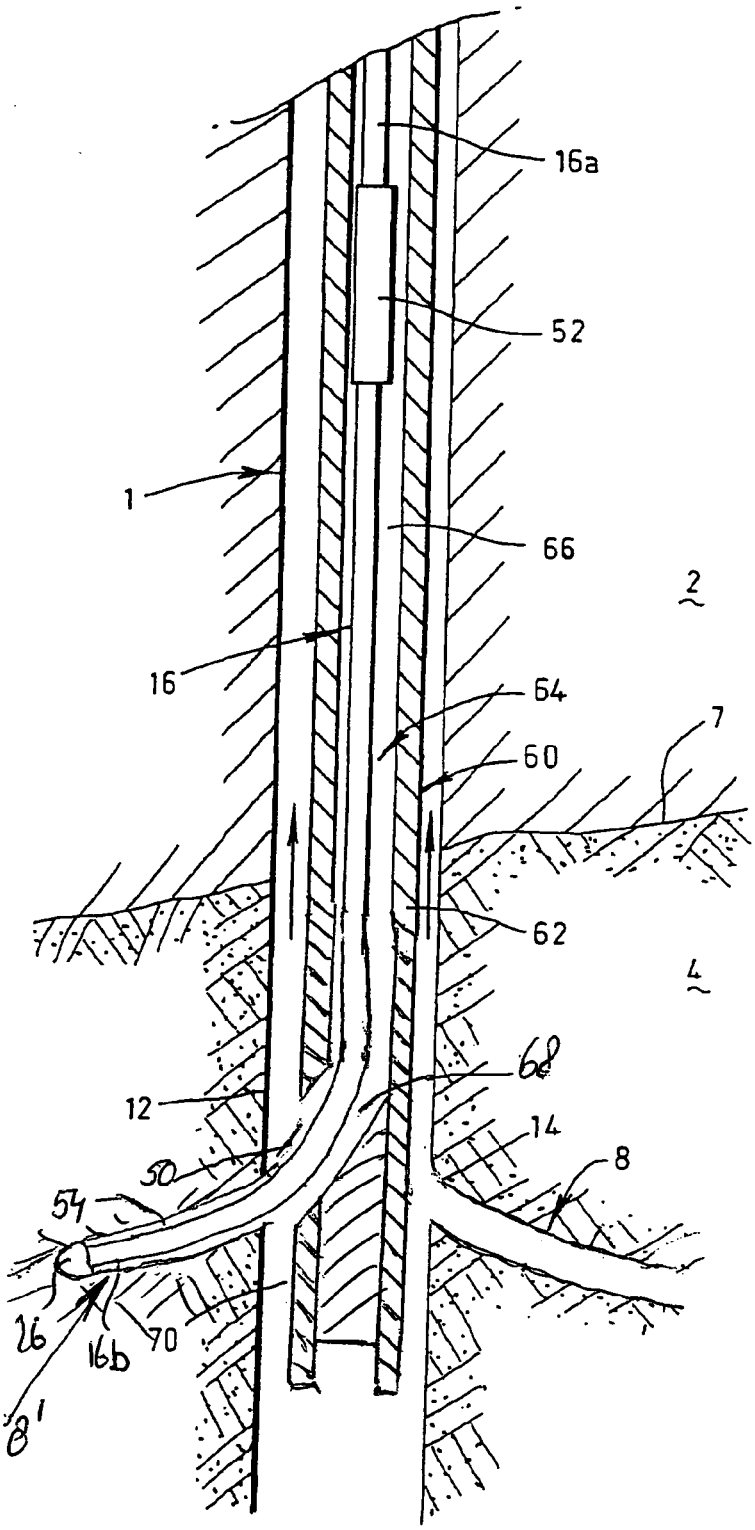
FIG. 6A schematically shows the embodiment of FIG. 6 in a reoriented position.

Normal operation of the embodiment of FIGS. 6 and 6A is similar to normal operation of the embodiment of FIG. 5.

In a modification to the embodiment of FIG. 5, the tubular part of the drill string 16 between the downhole motor 52 and the surface equipment is replaced by a cable (not shown) suitably connected to a hoisting device (not shown) at surface for lifting and lowering the drill string 16 through main borehole 1 and branch borehole 8. In such application the downhole motor 52 has a fluid inlet (not shown) at its upper end, and during operation drilling fluid is pumped to the motor 52 through the tubular element 62. The resulting differential pressure over the motor is utilised to generate a downward thrust on the drill string to generate WOB and overcome frictional forces on the flexible shaft assembly. For both configurations, i.e. the tubular drill string configuration and the cable configuration, the return stream of drilling fluid flows from the bit into the annular space between the tubular element and the casing 12 and/or open hole.

In the above-described method it is achieved that a branch borehole is drilled from the main borehole, which deviates from the main borehole at an ultra-short radius. This procedure allows the branch borehole to be initiated at a location below the cap rock layer, with the advantage that no stringent sealing requirements are imposed on the junction between the main borehole and the branch borehole since the cap rock layer prevents oil migration to surface.

I claim:

1. A method of drilling a borehole into an earth formation using a drill string having an upper part and a lower part which is more flexible than the upper part, the method comprising:

drilling a first section of the borehole;

drilling a second section of the borehole from said first borehole section, said second section extending at a selected inclination angle relative the first section, wherein during drilling of the second section the drill string is lowered through the borehole in a manner that the upper drill string part remains in the first section and the lower drill string part extends into the second borehole section, the first borehole section being substantially straight and the second borehole section being a curved section, wherein the lower drill string part is guided from the first borehole section into the second borehole section by means of a tubular housing or a tubular element arranged in the first borehole section, said tubular housing or tubular element having a passage through which the drill string extends, said passage having a lower end part directed towards the second borehole section, wherein the upper drill string part is provided with a downhole motor, which rotates the lower drill string part during drilling of the second borehole section, and wherein the lower drill string part is provided with a drill bit which is tilted relative to the longitudinal axis of the lower drill string part, wherein an orienting shaft extends between the downhole motor and the drill bit for orienting the drill bit in the borehole, and wherein the method further comprises rotating the orienting shaft over a selected angle so as to orient the drill bit in the second borehole section in correspondence with the desired direction of drilling of the second borehole section.

2. The method of claim 1, wherein the first borehole section forms a main borehole and the second borehole section forms a branch borehole of the main borehole.

3. The method of claim 2, wherein the tubular housing or the tubular element is cylindrical.

4. The method of claim 2, wherein the passage has an upper, longitudinal, section and a lower, curved, section directed to the second borehole.

5. The method of claim 2, wherein said tubular element is one of a drilling tubular and a production tubing extending from surface into the first borehole section.

6. The method of claim 1, wherein the tubular housing or the tubular element is cylindrical.

7. The method of claim 6, wherein the passage has an upper, longitudinal, section and a lower, curved, section directed to the second borehole.

8. The method of claim 6, wherein said tubular element is one of a drilling tubular and a production tubing extending from surface into the first borehole section.

9. The method of claim 1, wherein the passage has an upper, longitudinal, section and a lower, curved, section directed to the second borehole.

10. The method of claim 9, wherein the lower, curved, section is formed by a whipstock.

11. The method of claim 10, wherein said tubular element is one of a drilling tubular and a production tubing extending from surface into the first borehole section.

12. The method of claim 9, wherein said tubular element is one of a drilling tubular and a production tubing extending from surface into the first borehole section.

13. The method of claim 1, wherein said tubular element is one of a drilling tubular and a production tubing extending from surface into the first borehole section.

14. The method of claim 1, wherein the downhole motor is a hydraulic motor located in said passage.

15. The method of claim 14, wherein the motor is driven by a stream of fluid pumped through the passage.

16. The method of claim 15, wherein said stream of fluid exerts a downward force to the downhole motor so as to move the drill string in downward direction during drilling of the second borehole section.

17. The method of claim 1, wherein the orienting shaft is a tubular shaft through which the lower drill string part extends.

18. The method of claim 1, wherein prior to drilling the second borehole section the tubular housing or tubular element is oriented in accordance with a desired azimuthal direction.

19. The method of claim 1, wherein, after the second borehole section has been drilled, a third borehole section is drilled from the first borehole section in another azimuthal direction than that of the second borehole section.

20. The method of claim 1, wherein the tubular housing is at the lower end provided with a support profile matching a corresponding support profile of a support member anchored in the first borehole section, whereby the tubular housing is positioned on the support member.

21. The method of claim 20, wherein the support profiles of the tubular housing and the support member are such that the tubular housing is positionable on the support member at different azimuth angles in the first borehole section.

22. The method of claim 1, wherein the tubular housing or the tubular element is rotatably arranged in the first borehole section.

23. A method of drilling a borehole into an earth formation using a drill string having an upper part and a lower part which is more flexible than the upper part, the method comprising:

drilling a first section of the borehole;

anchoring a support member in the first borehole section;

drilling a second section of the borehole from said first borehole section, said second section extending at a selected inclination angle relative the first section, wherein during drilling of the second section the drill string is lowered though the borehole in a manner that the upper drill string part remains in the first section and the lower drill string part extends into the second borehole section, the first borehole section being substantially straight and the second borehole section being a curved section, wherein the lower drill string part is guided from the first borehole section into the second borehole section by means of a tubular housing or a tubular element rotatably arranged in the first borehole section relative to the support member, said tubular housing or tubular element having a passage through which the drill string extends, said passage having a lower end part directed towards the second borehole section.

24. The method of claim 23, wherein the first borehole section forms a main borehole and the second borehole section forms a branch borehole of the main borehole.

25. The method of claim 23, wherein the tubular housing or the tubular element is cylindrical.

26. The method of claim 23, wherein the lower end part of said passage comprises a curved section.

27. The method of claim 26, wherein the curved section is formed by a whipstock.

28. The method of claim 23, wherein, after the second borehole section has been drilled, a third borehole section is drilled from the first borehole section in another azimuthal direction than that of the second borehole section.

29. The method of claim 23, wherein the upper drill string part is provided with a downhole motor, which rotates the lower drill string part during drilling of the second borehole section.

30. The method of claim 23, wherein the tubular housing is at the lower end provided with a support profile matching a corresponding support profile of the support member anchored in the first borehole section, whereby the tubular housing is positioned on the support member.

31. The method of claim 30, wherein the support profiles of the tubular housing and the support member are such that the tubular housing is positionable on the support member at different azimuth angles in the first borehole section.

32. A method of drilling a borehole into an earth formation using a drill string having an upper part and a lower part which is more flexible than the upper part, the method comprising subsequent steps of:

drilling a first section of the borehole;

anchoring a support member in the first borehole section;

running a tubular housing or a tubular element in the first borehole section;

positioning the tubular housing or the tubular element on the anchored support member;

drilling a second section of the borehole from said first borehole section, said second section extending at a selected inclination angle relative the first section, wherein during drilling of the second section the drill string is lowered through the borehole in a manner that the upper drill string part remains in the first section and the lower drill string part extends into the second borehole section, the first borehole section being substantially straight and the second borehole section being a curved section, wherein the lower drill string part is guided from the first borehole section into the second borehole section by means of a tubular housing or a tubular element arranged in the first borehole section, said tubular housing or tubular element having a passage through which the drill string extends, said passage having a lower end part directed towards the second borehole section.

33. The method of claim 32, wherein prior to start of drilling the second section of the borehole, the tubular housing or the tubular element is oriented on the support member in accordance with a desired azimuthal direction.

34. The method of claim 32, wherein, after the second borehole section has been drilled, the tubular housing or the tubular element is re-oriented on the support member in order to drill a third borehole section in another azimuthal direction than that of the second borehole section.

35. The method of claim 32, wherein the tubular housing is at the lower end provided with a support profile matching a corresponding support profile of the support member anchored in the first borehole section.

36. The method of claim 35, wherein the support profiles of the tubular housing and the support member are such that the tubular housing is positionable on the support member at different azimuth angles in the first borehole section.

* * * * *